United States Patent [19]

Breitling

[11] 4,345,296

[45] Aug. 17, 1982

[54] DEVICE FOR CONTROLLING THE CURRENT THROUGH AN INDUCTIVE CONSUMER, ESPECIALLY A MAGNETIC VALVE IN THE FUEL METERING SYSTEM OF AN INTERNAL COMBUSTION ENGINE

[75] Inventor: Wolfram Breitling, Schwieberdingen, Fed. Rep. of Germany

[73] Assignee: Robert Bosch GmbH, Stuttgart, Fed. Rep. of Germany

[21] Appl. No.: 163,118

[22] Filed: Jun. 26, 1980

[30] Foreign Application Priority Data

Aug. 14, 1979 [DE] Fed. Rep. of Germany ..... 2932859

[51] Int. Cl.[3] ..... H01H 47/32

[52] U.S. Cl. ..... 361/154; 123/490

[58] Field of Search ..... 361/152, 154; 123/490

[56] References Cited

U.S. PATENT DOCUMENTS 3,786,314 1/1974 Misch ..... 361/154

*Primary Examiner*—Harry E. Moose, Jr.

*Attorney, Agent, or Firm*—Edwin E. Greigg

[57] ABSTRACT

A device is proposed for controlling the current through switching devices which function inductively, in particular magnetic valves in the fuel metering system of an internal combustion engine, with which it is possible to control the current during an attracting and maintenance phase. A primary characteristic is a bracketed and controllable constant-voltage source parallel to the base-emitter path of a switching transistor and of a measuring resistor. Furthermore, a threshold switch connected with its positive input to the measuring resistor is coupled with positive feedback, and the negative input of this threshold switch is connected to a voltage divider controllable in accordance with the input signal.

8 Claims, 2 Drawing Figures

DEVICE FOR CONTROLLING THE CURRENT THROUGH AN INDUCTIVE CONSUMER, ESPECIALLY A MAGNETIC VALVE IN THE FUEL METERING SYSTEM OF AN INTERNAL COMBUSTION ENGINE

BACKGROUND OF THE INVENTION

The invention relates to a device for controlling the current through an inductive consumer having switching devices which function inductively, in particular magnetic valves in the fuel metering system of an internal combustion engine, with which it is possible to control the current during an attracting and maintenance phase.

It is generally known to include the flow of electric current through inductive consumers, which act as switching elements, such as magnetic valves or relays, in an open-loop or closed-loop electric current control circuit. This is because during a so-called attracting phase high output must be delivered to the inductive consumer, for instance in order to be able to attain the most exact possible switching behavior over time. During a maintenance phase immediately following the attracting phase, the flow of current through the consumer can be dropped, because no further mechanical work must be performed; instead, the only energy required is that for keeping the magnetic valve, for instance, open. This energy is oriented to the restoring force of the element to be switched.

Two-point current governors are known in inductive consumers, wherein the flow of current through these consumers is switched on and off periodically in accordance with the various intensity of the electric current. The particular switching points are determined on the basis of the voltage drop over a current measuring resistor.

Consumer current governors of the analog type are also known, in which the flow of current is dropped to a maintenance value after the end of the attracting phase, and this analog value is then maintained by means of an electric current closed-loop control circuit.

The particular current threshold both for the maximum attracting current and for the maintenance current are detected in the prior art either via two separate threshold switches, or via one threshold switch having a reversible switching threshold. In both cases, the expense for circuitry is considerable, and it is one of the objects of the invention to create a device which is as simple as possible for controlling the current through an inductive consumer. The control of the consumer current in such a device corresponds in part to a closed-loop control procedure as well.

OBJECT AND SUMMARY OF THE INVENTION

The device according to the invention and having switching devices which function inductively, in particular magnetic valves in the fuel metering system of an internal combustion engine, with which it is possible to control the current during an attracting and maintenance phase has the advantage that it is simple in structure and can be produced with relatively few components, without being poorer in its functioning in comparison with the known control devices.

As a result of the characteristics disclosed in the dependent claims, advantageous further embodiments of and improvements to the device disclosed in the main claim are possible. Their advantages will become apparent from the following description of one exemplary embodiment.

The invention will be better understood and further objects and advantages thereof will become more apparent from the ensuing detailed description of a preferred embodiment taken in conjunction with the drawing.

DETAILED DESCRIPTION OF THE PREFERRED EMBODIMENT

Figure 1:
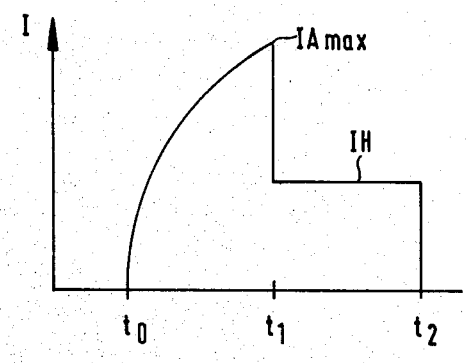
FIG. 1 is a pulse diagram chart of the current through an inductive consumer.

Referring now to the drawing, the exemplary embodiment relates to a terminal stage, whose current is controlled in closed-loop fashion, of an injection valve of an internal combustion engine. It is particularly important in electromagnetic switching elements, as inductive consumers in so-called on-board power networks, such as in a motor vehicle, to make do with as little energy as possible, so as first to keep the heating of the individual consumers as low as possible and second not to put an unnecessary load on the particular current source.

FIG. 1 shows in chart form a relationship of the current through an electromagnetic injection valve of an internal combustion engine, plotted over time. It can be seen that after a switch-on instant $t_0$, there is the steepest possible current increase up to a maximum attracting current $IA_{max}$ at the end of the so-called attracting phase at time $t_1$. The maintenance phase then follows, having a flow of current reduced to the maintenance current IH up to the end of the desired injection time at time $t_2$. The individual current values are adapted to the given characteristics of the injection valve. Thus, for example, the maximum attracting current must be selected to be so high that this attraction takes place reliably in every case, and the maintenance current is preferably selected to be as low as possible, in order to keep the heating of the magnetic valve low with a view to preventing undesired fuel heating. At the same time, the maintenance current IH must, however, keep the magnetic valve reliably open.

The individual negative edges in the pulse diagram of FIG. 1 are shown for the ideal case. Naturally, if the resolution were greater, gradations would be visible. The point of departure is that there is no pre-running circuit associated with the injection valve to which the current flow diagram of FIG. 1 pertains.

Figure 2:
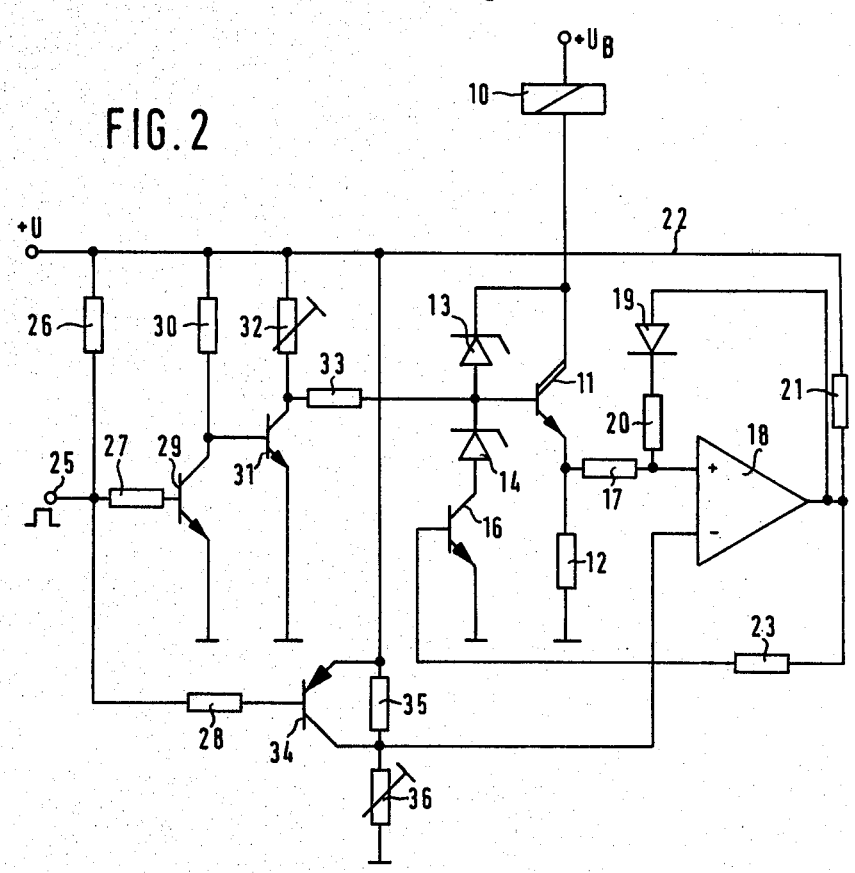
FIG. 2 is a schematic circuit diagram of one embodiment of the preferred device.

FIG. 2 shows an exemplary embodiment of a terminal stage, whose current is controlled in closed-loop fashion, with an injection valve in a fuel injection system.

The magnetic coil 10 of the injection valve (not shown), the collector-emitter path of a transistor 11 and a resistor 12 are disposed in series. The collector-base path of the transistor 11 is bridged over by a Zener diode 13. A series circuit comprising Zener diode 14 and a transistor 16 is disposed between the base of the transistor 11 and ground. The junction point of the transistor 11 and the resistor 12 is carried via a resistor 17 to the positive input of a threshold switch 18. Its output is first fed back via a series circuit comprising diode 19 and resistor 20 to a positive input of switch 18 and the output of switch 18 is connected via a resistor 21 with a positive line 22. The output of the threshold switch 18 is also coupled via a resistor 23 with the base of the transistor 16.

An input terminal 25 of the device is connected to a first resistor 26 which leads to the positive line 22 and resistors 27, 28 which lead respectively to the bases of two transistors 29, 34. The emitter of the transistor 29 is connected directly to ground; its collector receives the operational voltage, via a resistor 30, from the positive line 22 and this collector is connected with a base of a subsequent transistor 31. This transistor 31, as well, is disposed in an emitter circuit and its collector is coupled via a variable resistor 32 with the positive line 22 and via a resistor 33 with the base of the transistor 11.

By means of the collector-emitter path of the transistor 34, a first resistor 35 of a voltage divider comprising two resistors 35, 36 can be bridged over between the positive line 22 and ground. The junction point of the two resistors 35, 36 is in direct communication with a negative input of the threshold switch 18.

In a state of rest, the input terminal 25 has zero potential; as a result, the transistor 11 is blocked and no current flows through the magnetic coil 10. The positive input of the threshold switch 18 is connected via the two resistors 12 and 17 to ground and the negative input has the voltage potential of the positive line 22, because the transistor 34 is switched through. The output of the threshold switch 18 is thus at low potential and the transistor 16 is blocked.

At time $t_0$ corresponding to what is shown in FIG. 1, the potential at the input terminal 25 abruptly jumps to a positive value. As a result, the transistor 11 becomes conductive and the transistor 34 is blocked. The negative input of the threshold switch 18 is at average potential, which is established in accordance with the resistance values of the resistors 35 and 36 by means of the voltage divider ratio. The current through the magnetic coil 10 increases and thus the voltage drop over the resistor 12 also increases. As soon as the potential at the positive input of the threshold switch exceeds the potential of the negative input, the threshold switch reverses, and its output potential increases. Because of the positive feedback coupling via the diode 19- resistor 20, the voltage at the positive input is further increased, so that a voltage decrease at the resistor 12 does not lead to the switching back of the threshold switch. The transistor 16 is controlled to switch through by means of the positive threshold output signal. From this instant, the transistor 11 cooperates with the Zener diode 14 and with the resistor 12 in closed-loop control of the current, because the constant voltage drop over the Zener diode 14, driven in the blocking direction, is constant. Because the maintenance current between times $t_1$ and $t_2$, according to FIG. 1, is substantially lower than the peak current $IA_{max}$, the switching off of the closed-loop current control causes an approximate blockage of the transistor 11. The collector voltage of the transistor 11 increases up to the Zener voltage of the Zener diode 13, which causes a very rapid drop of the current through the magnetic coil 10 from a value of $IA_{max}$ to a value of IH.

The maintenance current IH is maintained until such time as the input potential at the input terminal 25 again returns to zero. Then the functioning of the Zener diode 13 acts to provide an extremely rapid current drop. With the switch back of the potential at the input terminal 25, the transistor 34 again becomes conductive, and the negative input of the threshold switch 18 is raised up to the potential of the positive line 22, and as a result the output potential of the threshold switch 18 again returns reliably to zero. The outset state is thus again attained.

The subject of FIG. 2 permits an extremely rapid switching by inductive adjustment members in general, while the above-described magnetic coil of an injection valve is given purely by way of example as one of many possible applications. The individual current values can be established within wide limits independently of one another. While the threshold value for the maximum attracting current $IA_{max}$ is established by way of the selection of the values of the two resistors 35,36, the intensity of the maintenance current IH is dependent upon the selection of the Zener diode parallel to the series circuit of the base-emitter path of the transistor 11 and of the resistor 12.

The primary characteristic of the subject of FIG. 2 is the so-called bracketing of the base potential of the transistor 11 by means of a constant-voltage source, realized in the described example by means of a Zener diode. It is also important that the exemplary embodiment makes do with only one threshold switch, without threshold value reversal, and the so-called bracketing is switched on in accordance with the attainment of the maximum attracting current $IA_{max}$.

In place of the Zener diode 14, a plurality of diodes switched in the flowthrough direction can also be used.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. Apparatus for controlling the current through an inductive consumer of the type requiring a higher current during an initial attracting phase than during a subsequent maintenance phase of its operation, comprising:

first switching means and current measuring means connected in series with the inductive consumer between operational voltage lines; and a threshold switch means, coupled with the current measuring means, for determining the transition between the initial attracting phase and the subsequent maintenance phase of the consumer operation;

the first switching means including at least one transistor, a controllable direct voltage source, and second switching means, actuated by the threshold switch means, for connecting the controllable direct voltage source parallel to a series circuit comprising at least one base-emitter path of the at least one transistor and a measuring resistor constituting the current measuring means, during the maintenance phase of the consumer operation.

2. Apparatus as defined by claim 1, wherein said controllable voltage source comprises a Zener diode and said second switching means comprises a second transistor disposed in series with the Zener diode.

3. Apparatus as defined by claim 1, wherein the threshold switch means includes an output, a positive input connected to the measuring resistor, and a negative input connected to a voltage divider controllable by an input signal of the apparatus.

4. Apparatus as defined by claim 3, wherein over the duration of the input signal, the negative input of the threshold switch is at an average potential of the voltage divider.

5. Apparatus as defined by claim 3, wherein the threshold switch means includes a positive feedback circuit connected between the output and the positive input of the threshold switch means.

6. Apparatus as defined by claim 1, wherein the inductive consumer is a magnetic valve in a fuel metering system of an internal combustion engine.

7. Apparatus as defined by claim 1, wherein said controllable voltage source comprises a plurality of diodes connected in series.

8. Apparatus, actuated by an input signal, for controlling the current through an inductive consumer of the type requiring a higher current during an initial attracting phase than during a subsequent maintenance phase of its operation, said apparatus comprising:

measuring resistor means for providing an output signal related to the inductive consumer current;

threshold switch means, connected to receive the measuring resistor means output signal and the apparatus input signal, for generating an output signal during the maintenance phase of the inductive consumer operation, said threshold switch means output signal being initiated when the inductive consumer current exceeds a first predetermined value indicating completion of the initial attracting phase of the inductive consumer operation; and first switching means, activated by the apparatus input signal, for connecting the inductive consumer in series with the measuring resistor means between two operational voltage lines, said first switching means including:

a transistor having a base, a collector, and an emitter, the transistor collector being connected through the inductive consumer to one operational voltage line and the transistor emitter being connected through the measuring resistor means to the other operational voltage line, base voltage supply means activated by the apparatus input signal, for supplying a voltage to the transistor base to render the transistor conductive between its collector and emitter, a switch device, connected to receive the threshold switch means output signal, which is closed, i.e., rendered conductive, by the threshold switch means output signal, and voltage limiting means, actuated by said switch device, for reducing the transistor base voltage provided by base voltage supply means so as to maintain the voltage across the transistor base-emitter path and the measuring resistor at an essentially constant value during the maintenance phase of the consumer operation, to thus maintain the inductive consumer current at an essentially constant second predetermined value which is less than said first predetermined value of the inductive consumer current signalling the end of the inital attracting phase of the consumer operation.

* * * * *